US005857642A

United States Patent [19]

Zinnbauer

[11] Patent Number: 5,857,642

[45] Date of Patent: Jan. 12, 1999

[54] PAPER TOWEL DISPENSER

[75] Inventor: Gerald B. Zinnbauer, Cornelius, N.C.

[73] Assignee: Hygiene Systems, Inc., Greensboro, N.C.

[21] Appl. No.: 920,191

[22] Filed: Aug. 25, 1997

[51] Int. Cl.[6] ..... A47K 10/24

[52] U.S. Cl. ..... 242/590; 242/593; 221/63; 221/303

[58] Field of Search ..... 242/590, 593; 221/44, 45, 46, 63, 303, 307, 308, 309; 225/90, 106

[56] References Cited

U.S. PATENT DOCUMENTS

| | | | |
|---|---|---|---|
| 1,297,110 | 3/1919 | Davis | 242/598.6 |
| 3,795,355 | 3/1974 | Gerstein | 225/106 |
| 3,843,017 | 10/1974 | Harrison | 221/63 |
| 3,982,659 | 9/1976 | Ross | 221/63 |
| 4,138,034 | 2/1979 | McCarthy | 221/48 |
| 4,244,502 | 1/1981 | Reed | 225/13 |
| 4,353,480 | 10/1982 | McFadyen | 221/63 |
| 4,905,868 | 3/1990 | Beane et al. | 221/44 |
| 5,141,171 | 8/1992 | Yang | 242/55.54 |
| 5,215,211 | 6/1993 | Eberle | 221/1 |
| 5,263,607 | 11/1993 | Temesvary et al. | 221/304 |
| 5,273,184 | 12/1993 | Rizzuto | 221/303 |
| 5,335,811 | 8/1994 | Morand | 221/45 |
| 5,346,064 | 9/1994 | Rizzuto | 206/409 |
| 5,370,338 | 12/1994 | Lewis | 242/593 |
| 5,715,971 | 2/1998 | Morand | 242/593 |

*Primary Examiner*—John P. Darling
*Attorney, Agent, or Firm*—Rhodes Coats & Bennett, L.L.P.

[57] ABSTRACT

A dispenser for feeding perforated paper towels from a continuous roll. The dispenser includes a dispenser body for containing the paper towel roll which may be mounted to a supporting surface such as a wall. A unique feeder assembly is attached to the dispenser body for dispensing an end portion of the continuous roll. The feeder assembly includes a feeder body having a back wall, first and a second side walls attached on each side edge and a bottom wall attached to the bottom edge of the back and side walls. A first aperture is located on the bottom wall of the feeder body and a face plate having a second aperture overlapping the first aperture also is attached to the feeder body. The pair of overlapping apertures are biased against one another for receiving and dispensing an individual paper towel. In the preferred embodiment, a removable flange attaches the feeder assembly to the dispenser body. The flange includes a locking mechanism for lockingly engaging the flange onto the dispenser body.

47 Claims, 4 Drawing Sheets

PAPER TOWEL DISPENSER

BACKGROUND OF THE INVENTION (1) Field of the Invention

The present invention relates generally to a dispensing apparatus and, more particularly, to an apparatus for dispensing paper towels from a continuous roll.

(2) Description of the Prior Art

Paper towel dispensers are commonly used for storing and dispensing products such as toilet tissue, hand towels, and others. Towels, for example, are stored in a continuous fashion such as in a continuous roll of perforated paper rolled into a cylindrical tube. The roll is housed in a container in which end of the paper is fed through a dispensing nozzle. During use, the user grasps the exposed end of the towel and pulls a sheet-length section. The pulling action of the user tears the towel giving the user a section for use and exposes the end of the next section to be used.

Unfortunately, most previously available paper towel dispensers have a number of shortcomings. First, the mechanisms used for dispensing the paper are complicated. For example, many mechanisms require the paper towel to be initially fed through a variety of slots, turns, and passages. This initial set-up is often time consuming and difficult since threading the towel requires it to be manipulated through the numerous bends and turns which are small and difficult to access. Once threaded, the paper can mis-tear if it is pulled too hard by the user requiring the paper to be re-threaded.

Second, due to the numerous mechanical components, these dispensers are often more expensive than less complicated dispensers and require additional maintenance to keep them in proper working condition.

In addition, present dispensers are only able to be used for one size or one strength of paper towel unless changed by the delivery man. As a result, variations in the characteristics of the paper due to different brands, styles, or manufacturing variances produce dispenser problems such as the paper being too wide or too narrow to be threaded through the dispenser. For example, towels are perforated to help control the size of the towel and provide an aesthetically pleasing edge when the towel is torn from the roll. Changes in the perforation resistance can result in the dispenser not adequately holding and tearing the roll resulting in additional sheets being inadvertently pulled from the dispenser causing wasted towels, frustrated users, and additional paper expensive. A perforation resistance that is less than the dispenser settings results in the towels tearing from the roll without pulling the next sheet into position requiring the machine to be opened and the towel to be threaded through the opening. Thus, current dispensers are unable to accommodate a variety of sizes without timely and troublesome adjustments to dispense various sizes.

Finally, many presently available dispensers do not provide for a user to dispense a towel using a single hand. The towel does not tear adequately from the roll leaving either too much or too little towel for the user Two hands are needed to grasp and provide constant tension to tear the towel in an adequate manner. Physically challenged persons are never able to use these types of dispensers and many bi-armed persons are unable to adequately use this dispenser when they only have one hand available such as when holding an object in one hand.

Thus, there remains a need for a new and improved paper towel dispenser in which the paper roll is easily threaded and can be easily and quickly refilled while, at the same time, can automatically handle varying sizes and strengths of paper without requiring adjustment.

SUMMARY OF THE INVENTION

The present invention is directed to a dispenser for feeding perforated paper towels from a continuous roll. The dispenser includes a dispenser body for containing the paper towel roll which may be mounted to a supporting surface such as a wall. A unique feeder assembly is attached to the dispenser body for dispensing an end portion of the continuous roll.

The feeder assembly includes a feeder body having a back wall, first and a second side walls attached on each side edge and a bottom wall attached to the bottom edge of the back and side walls. A first aperture is located on the bottom wall of the feeder body and a face plate having a second aperture overlapping the first aperture also is attached to the feeder body. The pair of overlapping apertures are biased against one another for receiving and dispensing an individual paper towel.

In the preferred embodiment, a removable flange attaches the feeder assembly to the dispenser body. The flange includes a locking mechanism for lockingly engaging the flange onto the dispenser body. The locking mechanism includes a slot for attaching with the dispenser body, the slot positioned on the outer portion of the flange and extending a predetermined distance along the perimeter of the flange. A flexible semi-arc is defined by the slot and the flange outer edge. The locking mechanism further includes a locking indent for attachment to the dispenser body.

Accordingly, one aspect of the present invention is to provide a dispenser for feeding perforated paper towels from a continuous roll. The dispenser includes: (a) a dispenser body for containing the paper towel roll; and (b) a feeder assembly attached to the dispenser body for dispensing an end portion of the continuous roll, the feeder assembly including a pair of overlapping apertures biased against one another for receiving and dispensing an individual paper towel.

Another aspect of the present invention is to provide a feeder assembly for dispensing a paper towel from a dispenser. The feeder assembly includes: (a) a feeder body having a back wall, first and a second side walls attached on each side edge and a bottom wall attached to the bottom edge of the back and side walls; (b) a first aperture located on the bottom wall of the feeder body; and (c) a face plate having a second aperture overlapping the first aperture attached to the feeder body, wherein the pair of overlapping apertures are biased against one another for receiving and dispensing an individual paper towel.

Still another aspect of the present invention is to provide a dispenser for feeding perforated paper towels from a continuous roll. The dispenser includes: (a) a dispenser body for containing the paper towel roll; (b) a feeder assembly attached to the dispenser body for dispensing an end portion of the continuous roll, the feeder assembly including: (i) a feeder body having a back wall, first and a second side walls attached on each side edge and a bottom wall attached to the bottom edge of the back and side walls; (ii) a first aperture located on the bottom wall of the feeder body; and (iii) a face plate having a second aperture overlapping the first aperture attached to the feeder body, wherein the pair of overlapping apertures are biased against one another for receiving and dispensing an individual paper towel; and (c) a flange for attaching the feeder assembly to the dispenser body.

These and other aspects of the present invention will become apparent to those skilled in the art after a reading of the following description of the preferred embodiment when considered with the drawings.

DESCRIPTION OF THE PREFERRED EMBODIMENTS

Figure 1:
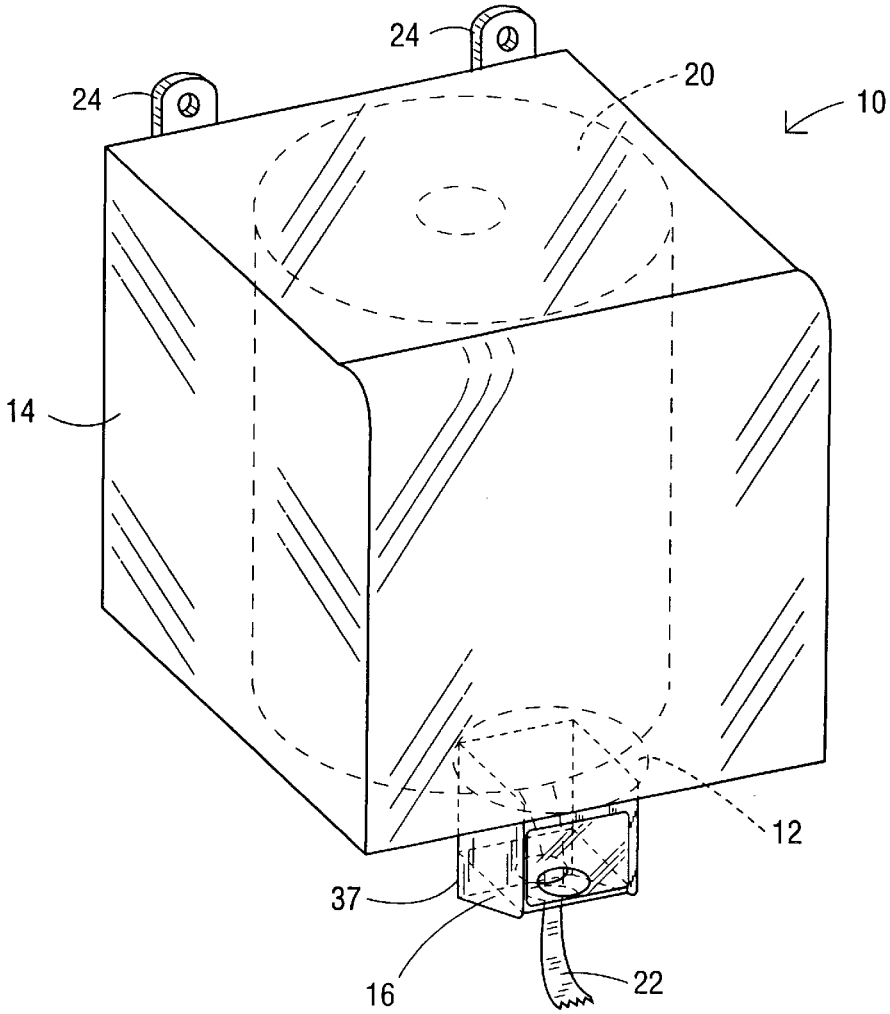
FIG. 1 is a front perspective view of a dispenser body and feeder assembly constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms. In addition, throughout this description, terms such as "paper towel" and "continuous roll" are used to define the dispensed product. It will be understood by one skilled in the art that a variety of paper product constructions and formats can be dispensed by the present invention.

Referring now to the drawings in general and FIG. 1 in particular, it will be understood that the illustrations are for the purpose of describing a preferred embodiment of the invention and are not intended to limit the invention thereto. As best seen in FIG. 1, a paper towel dispenser, generally designated 10, is shown constructed according to the present invention. The dispenser includes a dispenser body 14 having an attached feeder assembly 16 from which paper toweling is exposed. A flange 12 is used to connect the feeder assembly 16 to the dispenser body 14. A roll of toweling 20 is contained within the dispenser body 14 such that an end of the roll passes through the feeder assembly 16 and extends outside the dispenser. The dispenser body 14 protects the roll 20 from elements such as dirt and water. As shown in FIG. 1, the roll is maintained perpendicular to the ground. It will be understood by one of ordinary skill in the art that the roll can be positioned in a multitude of orientations as long as one of the ends can be fed through the feeder assembly 16. Attachments means 24 are positioned on the dispenser body 14 for mounting the dispenser 10 to a wall or similar support.

Figure 2:
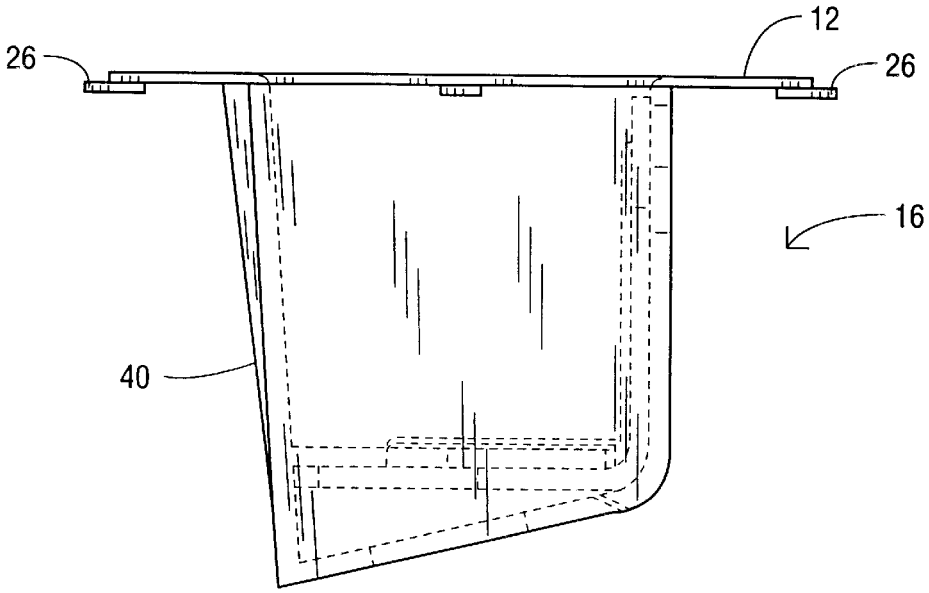
FIG. 2 is a side view of the feeder assembly.

The flange 12 attaches the feeder assembly 16 to the dispenser body 14. As best seen in FIG. 2, the flange 12 is integral with and attached to the top edge of the feeder assembly 16. A plurality of tabs 26 peripherally extend from the flange 12 for removably engaging the dispenser body 14. The tabs 26 are positioned around the circumference of the flange 12 to provide for a secure attachment. A preferred embodiment of the present invention includes four tabs located about the flange, but it is understood that a plurality of tabs may be arranged in various positions about the flange to accomplish attachment of the feeder assembly 16 to the dispenser body 14.

Figure 4:
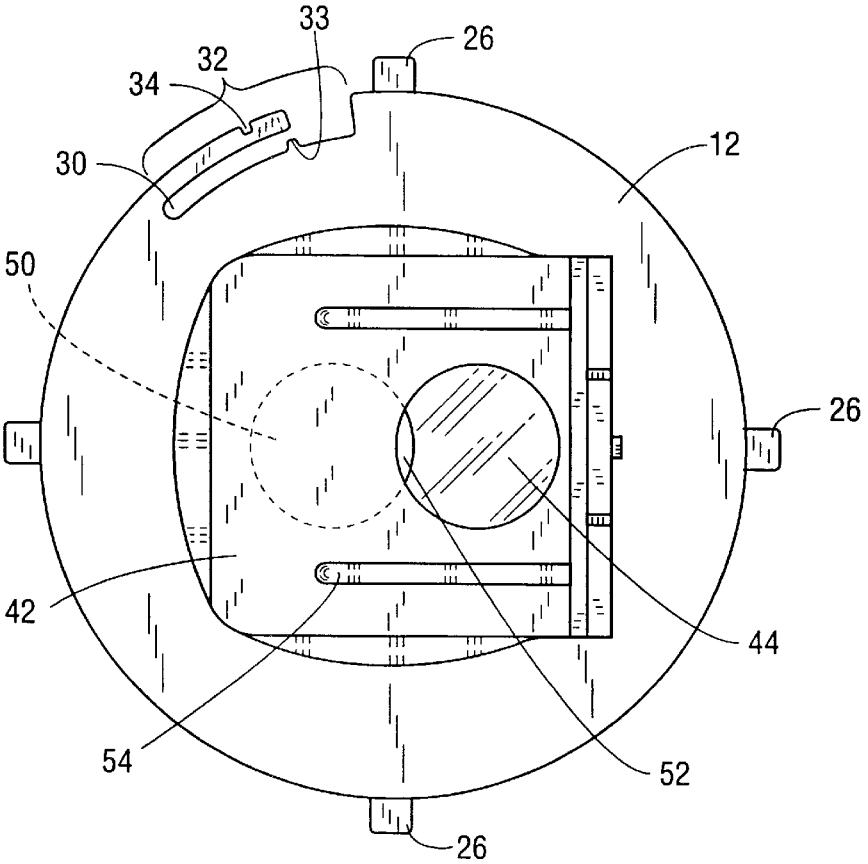
FIG. 4 is a top view of the feeder assembly.
Figure 5:
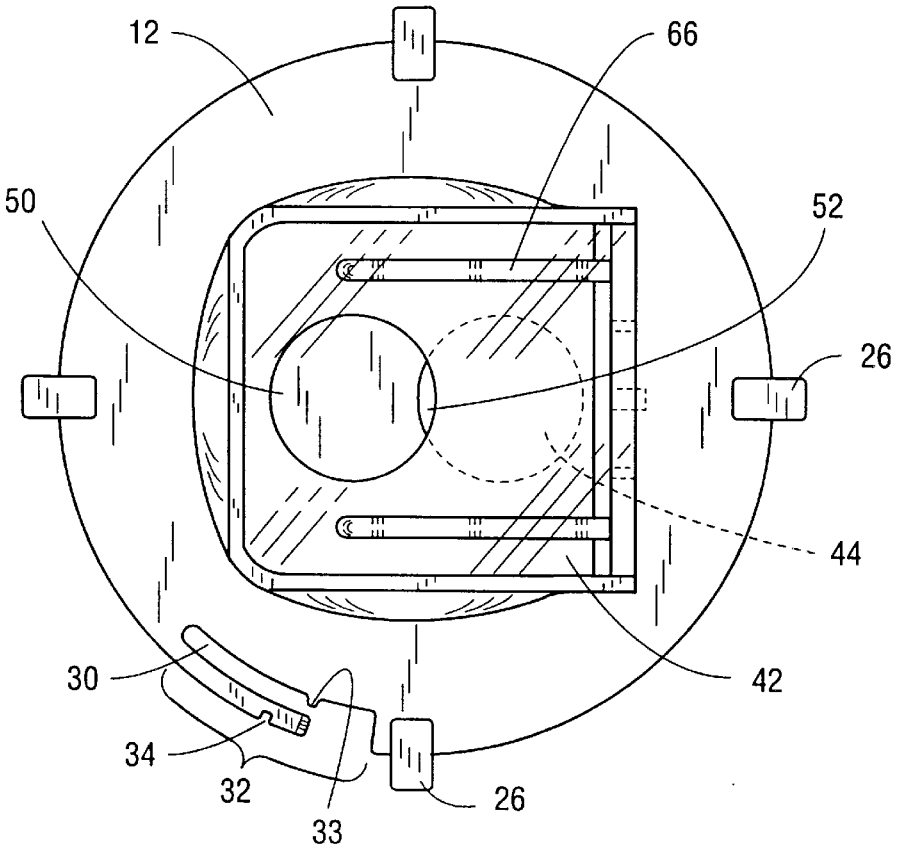
FIG. 5 is a bottom view of the feeder assembly.

As best seen in FIGS. 4 and 5, a slot 30, flexible semi-arc 32, and locking indent 34 are positioned along the edge of the flange 12. The slot 30 and resulting flexible semi-arc 32 extend a given length in an arcing configuration along the flange edge. In a preferred embodiment, the slot and flexible semi-arc are about 2 inches in length; the slot having a width of about ⅛ inch. During attachment to the dispenser body 14, the flexible semi-arc 32 flexes upward to allow engagement with an opposing attachment pin located in the dispenser body. In the preferred embodiment, a stop 33 prevents semi-arc 32 from moving inward and accidently releasing the lock. The combination of the tabs 26, slot 30, flexible semi-arc 32 and locking indent 34 provide for the flange to lockingly engage the dispenser body. This combination also allows for the flange 12 to be disengaged and removed from the dispenser body 14 if necessary, such as during threading of the paper towel through the feeder assembly 16 or for cleaning.

As shown in FIGS. 2–5, the feeder assembly 16 includes a back wall 40, adjacent side walls 36, and a bottom wall 42. The bottom wall 42 includes a first aperture 44 substantially sized for feeding through the paper towel. In a preferred embodiment, the first aperture 44 is generally cylindrical to better allow the towel to freely slide without snagging. The top of the feeder assembly between the bottom wall 42 and the dispenser body 14 is open permitting the paper towel to pass. Preferably, the feeder assembly is constructed of a rigid material, such as plastic, to protect the dispensing towels from outside elements such as water or dirt.

Figure 6:
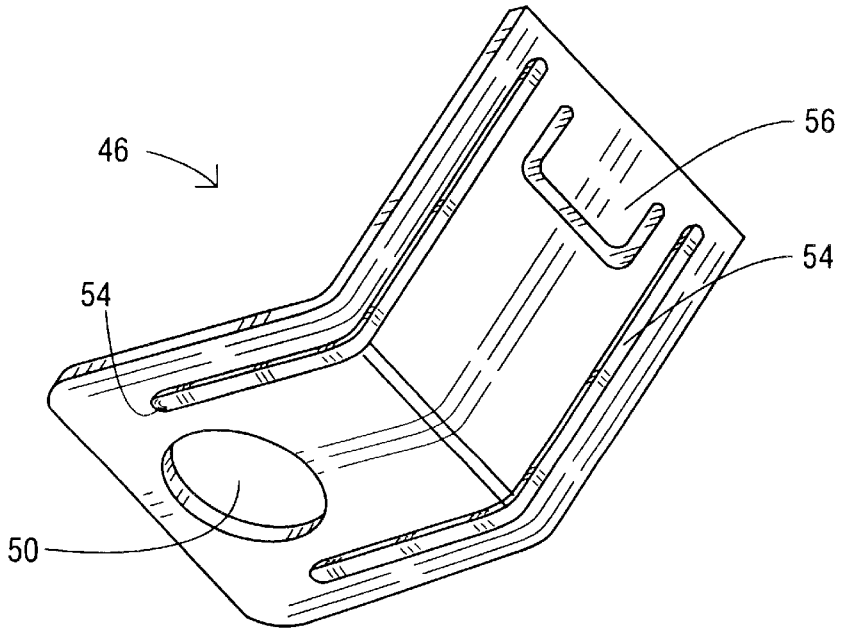
FIG. 6 is a side perspective view of the face plate removed from the feeder assembly.

A face plate 46 is removably engaged to cover the feeder assembly front and bottom wall 42. The face plate 46 is preferably "L-shaped", as shown in FIG. 6, to be positioned into the feeder assembly 16 and substantially cover the front and bottom walls. A second aperture 50 is positioned on one side of the face plate such that when the face plate is attached to the feeder assembly 16, the first aperture 44 and second aperture 50 are offset from one another resulting in an opening 52 through which the paper towel extends. The second aperture 50 also is preferably generally cylindrical and comparably sized as the first aperture 44. It will be understood by one skilled in the art that the first and second apertures could be of a variety of overlapping, complementary, configurations and still achieve the desired result.

The face plate 46 further includes ribs 54 that extend parallel along the face plate edges. The ribs 54 provide support and strength and extend substantially the entire length of the face plate 46. In a preferred embodiment, the face plate 46 is constructed of a transparent material, such as plastic, to allow the user to view into the interior of the feeder assembly 16 and see that the paper towel is available for dispensing.

Figure 3:
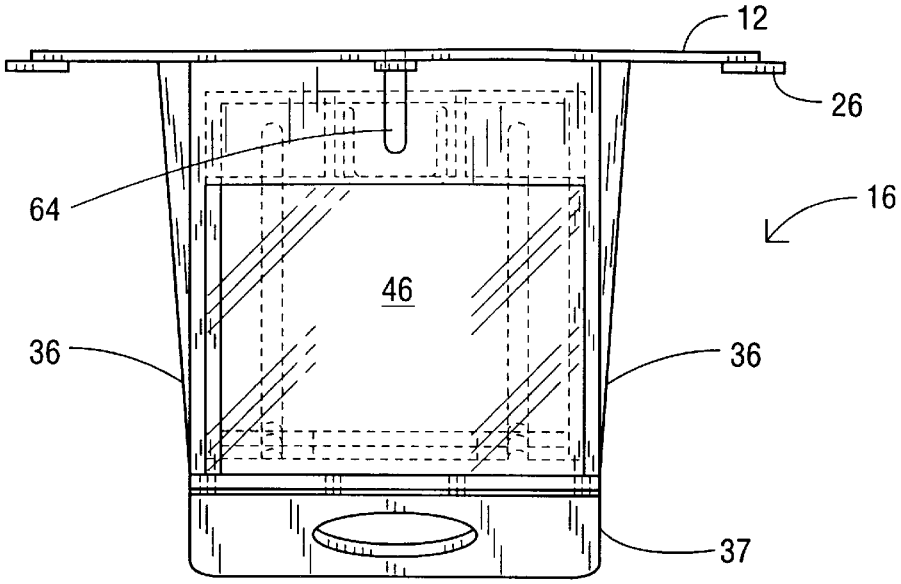
FIG. 3 is an front view of the feeder assembly.
Figure 7:
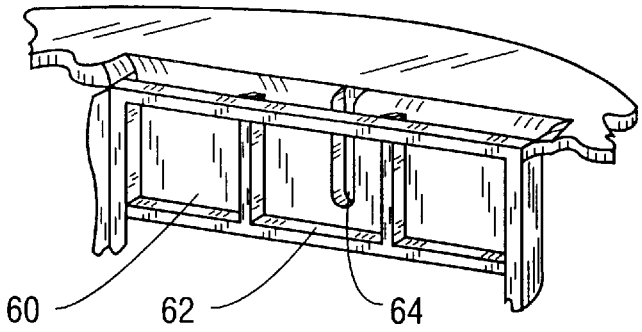
FIG. 7 is a front perspective view of the face plate attachment mechanism on the interior front wall of the feeder assembly.

A locking tab 56 is positioned on the upper edge of the face plate 46 to provide attachment to the feeder assembly 16. The locking tab 56 is flexible such that when the face plate is slid into the feeder assembly, the tab pushes inward as it slides against a shoulder 62 in the interior front wall 60 of the feeder assembly (see FIG. 7). When the locking tab 56 is slid above the shoulder 62, the tab extends outward over the shoulder thereby locking the face plate onto the feeder assembly. The shoulder 62 extends outward from the interior front wall of the feeder assembly such that when the face plate is slid into the feeder assembly a predetermined distance, the locking tab 56 extends to engage the shoulder and firmly attach the face plate to the feeder assembly. When the face plate is slid onto the feeder assembly, the ribs 54 slide into corresponding grooves 66 on the exterior side of the bottom wall. In this position, the interior of the feeder assembly is completely enclosed as shown in FIGS. 1 and 3.

A slot 64 is positioned on the feeder assembly front wall to provide an access to push the locking tab 56 inward to disengage the shoulder 62. By pushing through the slot against the locking tab 56, the tab is flex away from the shoulder 62. Once disengaged, the face plate 46 can be removed from the feeder assembly 16 for cleaning or inspection.

Figure 8A:
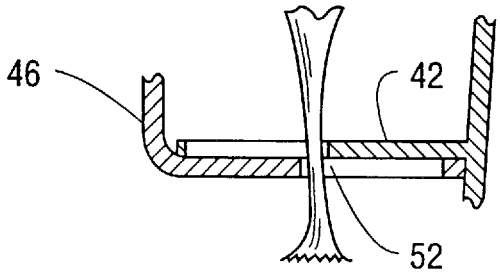
FIG. 8*a* is a cross sectional view of the feed opening in the feeder assembly in the un-flexed arrangement.
Figure 8B:
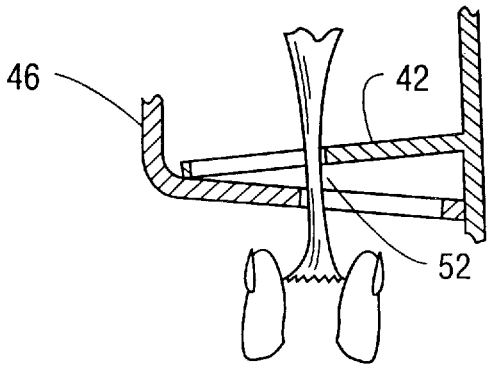
FIG. 8*b* is a cross sectional view of the feed opening in the feeder assembly in an enlarged, flexed arrangement.

In operation, the face plate 46 flexes outwardly away from the back wall to regulate the size of the elliptical opening 52. The flexing of the face plate provides for a pressure to be exerted against on the towel as it passes through the opening. When the thickness of the paper mass is less than the opening 52, the face plate remains stationary as shown in FIG. 8*a*. When the thickness of the paper mass is greater than the opening 52, the face plate flexes forward causing the opening to enlarge and allow the paper to pass as shown in FIG. 8*b*. While, in the preferred embodiment, the cantilevered attachment of the face plate to feeder assembly and the resilient nature of the plastic material provides a biasing force (see FIG. 8*a*), a spring or similar element could also be utilized.

The pressure on the paper applied at the opening acts to calibrate the size of the paper dispensed. When the paper is pulled by the user in a downward fashion, the pressure exerted on the paper at the opening is less than the strength of the non-serrated portion of the towel but more than the strength of perforated portion causing the paper to tear at the perforation. The geometry of a continuous, perforated paper towel is such that a portion of the subsequent towel will extent through the opening a distance to provide a grasping length for the next user.

Certain modifications and improvements will occur to those skilled in the art upon a reading of the foregoing description. By way of example, side wall 36 may extend downwardly past bottom wall 42 and at least partially underneath face plate 36 to help prevent tampering with the flexible portion of face plate 46 by forming a three-sided protective shroud 37. Also, the present invention could be adapted for flat towels by modifying the apertures to form semi-arcs. Finally, other sheet-type paper products could also be dispensed using the present invention. It should be understood that all such modifications and improvements have been deleted herein for the sake of conciseness and readability but are properly within the scope of the following claims.

I claim:

1. A dispenser for feeding perforated paper towels from a continuous roll, said dispenser comprising:

(a) a dispenser body for containing said paper towel roll;

(b) a feeder assembly attached to said dispenser body for dispensing an end portion of said continuous roll, said feeder assembly including a pair of overlapping apertures biased against one another for receiving and dispensing an individual paper towel; and (c) a flange for attaching said feeder assembly to said dispenser body said flange includes a plurality of tabs extending outwardly from the perimeter of said flange for attaching said dispenser body with said feeder assembly.

2. The apparatus according to claim 1, wherein said dispenser body includes means for attaching said dispenser body to a support.

3. The apparatus according to claim 1, wherein said dispenser body includes front, back, side and top walls for protecting said paper towel roll for external elements.

4. The apparatus according to claim 1, wherein four tabs extend from said flange.

5. The apparatus according to claim 1, wherein said flange includes a locking mechanism for lockingly engaging said flange onto said dispenser body.

6. The apparatus according to claim 5, wherein said locking mechanism includes a slot for attaching with said dispenser body, said slot positioned on the outer portion of said flange and extending a predetermined distance along the perimeter of said flange.

7. The apparatus according to claim 6, wherein said slot is about 2 inches long.

8. The apparatus according to claim 6, wherein said locking mechanism further includes a flexible semi-arc defined by said slot and said flange outer edge; said flexible semi-arc being about equal in length with said slot.

9. The apparatus according to claim 8, wherein said flexible semi-arc is about ¼ inch in width.

10. The apparatus according to claim 8, wherein said locking mechanism further includes a locking indent for attachment to said dispenser body.

11. The apparatus according to claim 10, wherein said locking indent is positioned along said flexible semi-arc.

12. A feeder assembly for dispensing a paper towel from a dispenser, said feeder assembly comprising:

(a) a feeder body having a back wall, first and a second side walls attached on each side edge and a bottom wall attached to the bottom edge of said back and side walls;

(b) a first aperture located on said bottom wall of said feeder body; and (c) a face plate having a second aperture overlapping said first aperture attached to said feeder body, wherein said pair of overlapping apertures are biased against one another for receiving and dispensing an individual paper towel, wherein said face plate is "L-shaped" and cantilevered at the end opposite said second aperture.

13. The apparatus according to claim 12, wherein said feeder assembly is constructed of a rigid material for protecting said paper towels.

14. The apparatus according to claim 13, wherein said feeder assembly is constructed of plastic.

15. The apparatus according to claim 12, wherein said first aperture is generally cylindrical to allow said paper towel to pass through without snagging.

16. The apparatus according to claim 15, wherein said second aperture is substantially the same size and shape as said first aperture.

17. The apparatus according to claim 12, wherein said face plate is preferably transparent for allowing the user to view into said feeder assembly.

18. The apparatus according to claim 17, wherein said face plate is plastic.

19. The apparatus according to claim 12, wherein said face plate further includes two ribs extending substantially the length of said face plate for providing additional rigidity.

20. The apparatus according to claim 19, wherein said ribs are in parallel orientation and extend along the edges of said face plate.

21. The apparatus according to claim 20, wherein said means of biasing said face plate includes a lip and a shoulder for receiving the edge of said face plate opposite said second aperture.

22. The apparatus according to claim 21, wherein said face plate further including a tab for locking said face plate to said lip and said shoulder of said feeder body, said tab being substantially flexible to allow for removably engaging said feeder body.

23. The apparatus according to claim 22, further including a groove positioned on said front wall to provide access to said tab for removing said face plate from said feeder assembly.

24. A dispenser for feeding perforated paper towels from a continuous roll, said dispenser comprising:

(a) a dispenser body for containing said paper towel roll;

(b) a feeder assembly attached to said dispenser body for dispensing an end portion of said continuous roll, said feeder assembly including: (i) a feeder body having a back wall, first and a second side walls attached on each side edge and a bottom wall attached to the bottom edge of said back and side walls; (ii) a first aperture located on said bottom wall of said feeder body; and (iii) a face plate having a second aperture overlapping said first aperture attached to said feeder body, wherein said pair of overlapping apertures are biased against one another for receiving and dispensing an individual paper towel; and (c) a flange for attaching said feeder assembly to said dispenser body.

25. The apparatus according to claim 24, wherein said flange includes a plurality of tabs extending outwardly from the perimeter of said flange for attaching said dispenser body with said feeder assembly.

26. The apparatus according to claim 25, wherein four tabs extend from said flange.

27. The apparatus according to claim 24, wherein said flange includes a locking mechanism for lockingly engaging said flange onto said dispenser body.

28. The apparatus according to claim 27, wherein said locking mechanism includes a slot for attaching with said dispenser body, said slot positioned on the outer portion of said flange and extending a predetermined distance along the perimeter of said flange.

29. The apparatus according to claim 28, wherein said slot is about 2 inches long.

30. The apparatus according to claim 28, wherein said locking mechanism further includes a flexible semi-arc defined by said slot and said flange outer edge; said flexible semi-arc being about equal in length with said slot.

31. The apparatus according to claim 30, wherein said flexible semi-arc is about ¼ inch in width.

32. The apparatus according to claim 30, wherein said locking mechanism further includes a locking indent for attachment to said dispenser body.

33. The apparatus according to claim 32, wherein said locking indent is positioned along said flexible semi-arc.

34. The apparatus according to claim 24, wherein said dispenser body includes means for attaching said dispenser body to a support.

35. The apparatus according to claim 24, wherein said dispenser body includes front, back, side and top walls for protecting said paper towel roll for external elements.

36. The apparatus according to claim 24, wherein said feeder assembly is constructed of a rigid material for protecting said paper towels.

37. The apparatus according to claim 36, wherein said feeder assembly is constructed of plastic.

38. The apparatus according to claim 24, wherein said first aperture is generally cylindrical to allow said paper towel to pass through without snagging.

39. The apparatus according to claim 38, wherein said second aperture is substantially the same size and shape as said first aperture.

40. The apparatus according to claim 29, wherein said face plate is preferably transparent for allowing the user to view into said feeder assembly.

41. The apparatus according to claim 40, wherein said face plate is plastic.

42. The apparatus according to claim 24, wherein said face plate is "L-shaped" and cantilevered at the end opposite said second aperture.

43. The apparatus according to claim 24, wherein said face plate further includes two ribs extending substantially the length of said face plate for providing additional rigidity.

44. The apparatus according to claim 43, wherein said ribs are in parallel orientation and extend along the edges of said face plate.

45. The apparatus according to claim 44, wherein said means of biasing said face plate includes a lip and a shoulder for receiving the edge of said face plate opposite said second aperture.

46. The apparatus according to claim 45, wherein said face plate further including a tab for locking said face plate to said lip and said shoulder of said feeder body, said tab being substantially flexible to allow for removably engaging said feeder body.

47. The apparatus according to claim 46, further including a groove positioned on said front wall to provide access to said tab for removing said face plate from said feeder assembly.

* * * * *